US008786654B2

(12) United States Patent
Nakajima

(10) Patent No.: US 8,786,654 B2
(45) Date of Patent: Jul. 22, 2014

(54) OPTICAL PRINT HEAD AND IMAGE FORMING APPARATUS

(71) Applicant: Tomohiro Nakajima, Kanagawa (JP)

(72) Inventor: Tomohiro Nakajima, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/632,504

(22) Filed: Oct. 1, 2012

(65) Prior Publication Data

US 2013/0088558 A1 Apr. 11, 2013

(30) Foreign Application Priority Data

Oct. 11, 2011 (JP) ..... 2011-224109

(51) Int. Cl.

| | |
|---|---|
| ***B41J 2/385*** | (2006.01) |
| ***B41J 2/39*** | (2006.01) |
| ***B41J 15/14*** | (2006.01) |
| ***B41J 27/00*** | (2006.01) |
| ***B41J 2/45*** | (2006.01) |

(52) U.S. Cl.

USPC ..... 347/238; 347/130; 347/137; 347/141; 347/244; 347/258

(58) Field of Classification Search

USPC ..... 347/111, 112, 129, 130, 134, 137, 141, 347/224, 225, 233, 238, 241, 244, 256, 258

See application file for complete search history.

(56) References Cited

U.S. PATENT DOCUMENTS

| | | | | |
|---|---|---|---|---|
| 2008/0013115 | A1* | 1/2008 | Nakano | 358/1.9 |
| 2009/0009867 | A1* | 1/2009 | Sowa et al. | 359/507 |
| 2010/0245525 | A1 | 9/2010 | Morimoto et al. | |

FOREIGN PATENT DOCUMENTS

| | | |
|---|---|---|
| JP | 2000-206854 | 7/2000 |
| JP | 2001-175046 | 6/2001 |
| JP | 2006-218656 | 8/2006 |
| JP | 2007-072321 | 3/2007 |
| JP | 2008-080613 | 4/2008 |
| JP | 2008-173811 | 7/2008 |
| JP | 2011-025631 | 2/2011 |

* cited by examiner

*Primary Examiner* — Alessandro Amari
*Assistant Examiner* — Kendrick Liu
(74) *Attorney, Agent, or Firm* — Oblon, Spivak, McClelland, Maier & Neustadt, L.L.P.

(57) ABSTRACT

An optical print head having a substrate on which multiple light sources aligned in a main scanning direction are mounted to emit beams of light in a direction perpendicular to a surface of the substrate; a lens array to focus the beams of light on an image bearing member to form an image thereon; a housing having a guiding portion extending in the main scanning direction to position the substrate and the lens array; a cleaner to clean a light-emitting surface of the lens array while moving in the main scanning direction; a moving device to move the cleaner; and a supporting member to support the housing and the cleaner. The supporting member rotatably supports the cleaner about a shaft and the guiding portion contacts the cleaner against the light-emitting surface of the lens array with a constant force over the main scanning direction during cleaning of the light-emitting surface.

10 Claims, 7 Drawing Sheets

OPTICAL PRINT HEAD AND IMAGE FORMING APPARATUS

CROSS-REFERENCE TO RELATED APPLICATION

This patent application is based on and claims priority pursuant to 35 U.S.C. §119 to Japanese Patent Application No. 2011-224109, filed on Oct. 11, 2011, the entire disclosure of which is hereby incorporated by reference herein.

BACKGROUND OF THE INVENTION

1. Field of the Invention

The present invention relates to an optical print head and image forming apparatus.

2. Description of the Background Art

In an optical print head employing a solid writing system using an LED array or an organic electro luminescence (EL) array as a light source, the operating distance of the lens array is short and a gap between the light-emitting surface and the surface of an image bearing (photoconductor) drum is extremely small; i.e., 2-3 mm.

Consequently, toner and paper dust adhering to the surface of the image bearing drum and toner stirred up by a developing roller are scattered by the rotation of the drum and adhere to the light-emitting surface of the lens array.

If left alone, such attached materials block beams of light that scan the surface of the image bearing drum, thereby reducing the amount of light reaching the image bearing drum, which leads to a reduction in image density and uneven density (i.e., vertical streaks) in the output image, that is, degraded image quality.

Typically, the print head is constructed of a main part having a substrate on which a light source is mounted, a lens array, and a housing that holds these at their arranged positions, and a supporting member for installing the main part in the frame of an image forming apparatus.

The supporting member is configured to bring a cleaner into contact with the light-emitting surface of the lens array and move the cleaner in the main scanning direction while maintaining contact with the light-emitting surface of the lens array.

The cleaner typically has a pad made of unwoven fabric such as felt having a sheet form made by compressing animal hair.

Although effective, cleaning performance is not satisfactory when such a felt has a weak contact force.

Conversely, if the contact force is excessively strong, it prevents the cleaner from moving smoothly, resulting in uneven cleaning and in the worst case damage to the light-emitting surface.

Therefore, providing a predetermined constant contact force of the felt against the light-emitting surface of the lens array in the main scanning direction (moving direction) is required.

In addition, in the optical print head employing a solid writing system using an LED array or an organic electro luminescence (EL) array as a light source, the focal depth of the lens array is shallow.

Therefore, unless the lens array and the surface of the image bearing drum are positioned to within ±0.1 mm of their proper locations, the beam spot of the light beam directed onto and scanning the image bearing drum becomes blurred.

Therefore, the position of the optical print head is determined by having projections that abut the image bearing drum or the supporting member at both ends in the main scanning direction in order that the light-emitting surface of the lens array and the surface of the image bearing drum precisely maintain their relative positions.

Where such a cleaner is provided, the range of movement of the cleaner is limited to the area between the projections.

Therefore, depending on the positioning of the projections, there is no space for retraction of the cleaner during printing.

The problem can be solved by configuring matters so that the cleaner can be retracted outside the projections, but such an arrangement requires that contact between the projections and the image bearing drum or the supporting member be temporarily broken.

This is also true in a case in which structural factors such as the supporting member of image bearing drum prevent movement of the cleaner in the main scanning direction.

That is, it is necessary to clean the light-emitting surface after it is moved away and separated from the surface of the image bearing drum.

Japanese Patent Application Publication No. (JP-A) 2011-025631 describes a structure in which a cleaner to clean the light-emitting surface of the LED print head is reciprocatorily moved in the longitudinal direction of the LED print head by a driving mechanism having a screw shaft and a slider screwed thereto while the cleaner is sandwiched between the image bearing member and the light-emitting surface.

JP2007-072321-A describes a structure having a guiding device to move a cleaner from a retracted position situated at the outside of one end of the LED print head relative to the height direction of the light-emitting surface to contact the cleaner with the light-emitting surface and guide the cleaner to clean the light-emitting surface of the LED print head along the light-emitting surface.

JP2000-206854-A describes a structure having a process cartridge and a cleaner integrally provided thereto.

The process cartridge has at least one image forming unit and is detachably attachable to an image forming apparatus.

The cleaner contacts and cleans the light-emitting surface of an LED print head upon detachment and attachment of the process cartridge.

JP2001-175046-A describes a structure having an LED array head movable between a first position at which the image bearing member is distant from the LED array head with a predetermined distance and a second position at which the LED array head is moved away from the first position relative to the image bearing member.

In the structure described in JP2011-025631-A mentioned above, since the LED print head and the screw shaft are independent from each other and the cleaner moves by the slider screwed to the screw shaft, it is difficult to keep a constant contact pressure of the cleaner against the LED print head along the longitudinal direction, i.e., the main scanning direction of the LED print head.

In addition, in the structures described in JP2007-072321-A and JP2001-175046-A mentioned above, it is not highly secured that the cleaner moves in the state in which the light-emitting surface of the print head and the image bearing member are separated.

SUMMARY OF THE INVENTION

In view of the foregoing, the present invention provides an optical print head having a substrate on which multiple light sources aligned in the main scanning direction are mounted to emit beams of light in a direction perpendicular to the surface of the substrate; a lens array to focus the beams of light on an image bearing member to form an image thereon; a housing having a guiding portion extending in the main scanning direction to position the substrate and the lens array; a cleaner to clean the light-emitting surface of the lens array while moving in the main scanning direction; a moving device operatively connected to the cleaner to move the cleaner; and a supporting member to support both the housing and the cleaner, wherein a first end of the cleaner in the sub-scanning direction perpendicular to the main scanning direction is rotatably supported by the supporting member to be rotatable around a shaft parallel to the main scanning direction and a second end of the cleaner opposite the first end engages the guiding portion to contact the cleaner against the light-emitting surface of the lens array with a constant force while the cleaner moves over the light-emitting surface in the main scanning direction during cleaning of the light-emitting surface.

As another aspect of the present invention, an optical print head is provided which includes a substrate on which multiple light sources aligned in the main scanning direction are mounted to emit beams of light in a direction perpendicular to the surface of the substrate; a lens array to focus the beams of light on an image bearing member to form an image thereon; a housing having a guiding portion extending in the main scanning direction to position the substrate and the lens array; a cleaner to clean the light-emitting surface of the lens array while moving in the main scanning direction; a moving device operatively connected to the cleaner to move the cleaner; a supporting member to support both the housing and the cleaner, and an evacuation area where the cleaner does not face the light-emitting surface of the lens array and which accommodates a scraping member to scrape foreign objects attached to the cleaner, the evacuation area being provided on at least one end of the housing in the main scanning direction.

As another aspect of the present invention, an image forming apparatus is provided which includes an image bearing member; an irradiator comprising the optical print head mentioned above to irradiate the image bearing member to form a latent electrostatic image thereon to according to image data; a development device to develop the latent electrostatic image with toner to obtain a visual image; and a transfer device to transfer the visual image to a recording medium.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein:

FIG. 3A is a side view illustrating an example of an arrangement of apertures thereof from the reverse side of the light-emitting surface of the optical print head, FIG. 3B is a side view illustrating another example of an arrangement of the aperture, and FIG. 3C is an end-on view of the optical print head of the first Embodiment;

DETAILED DESCRIPTION OF THE INVENTION

The present disclosure is described with reference to the accompanying drawings.

First, a first embodiment (optical print head) is described with reference to FIG. 1 through 7.

Figure 1:
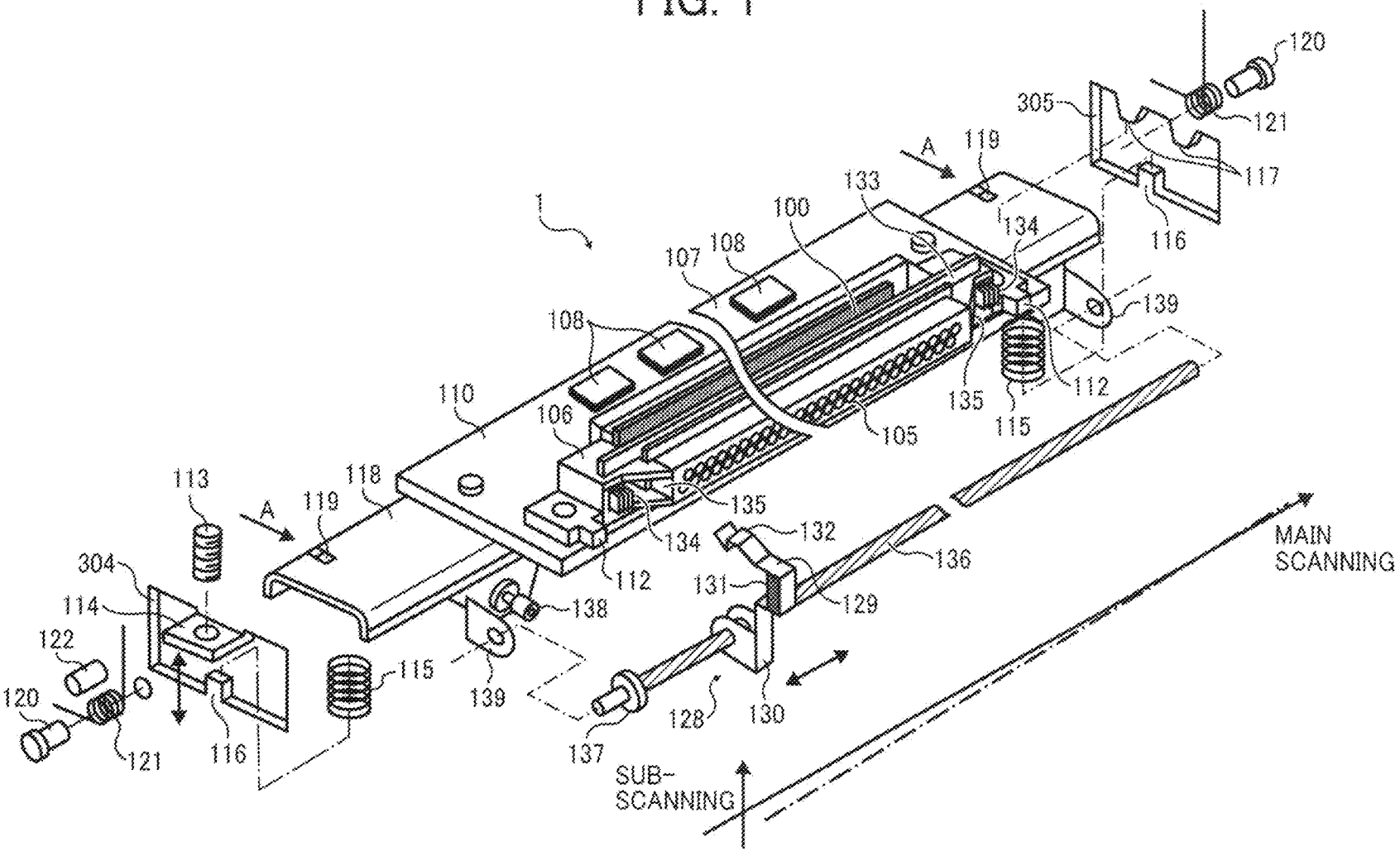
FIG. 1 is an exploded perspective view illustrating a unit in which an example of an optical print head of the first embodiment described later.

FIG. 1 is an example of an optical print head 1 having an organic EL (electroluminescence) substrate 100 arranged vertical to the print substrate surface.

A light source is installed on the substrate.

Figure 2:
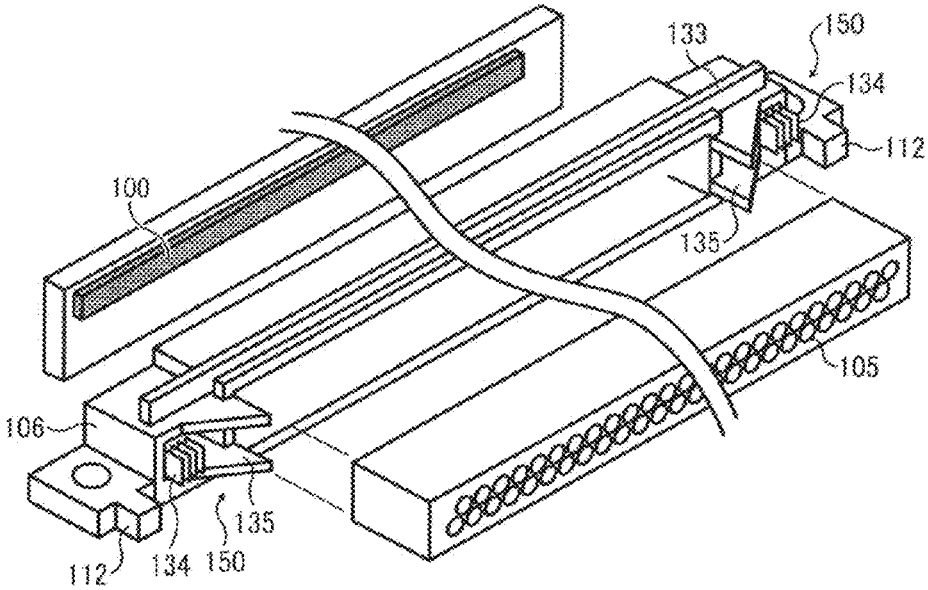
FIG. 2 is an exploded perspective view of the optical print head.

FIG. 2 is a perspective view illustrating a housing 106 that supports the organic EL substrate 100 and a rod lens array 105.

A light source is installed on the organic EL substrate 100. FIG. 3C is an end-on view of the optical print head unit from a plane perpendicular to the main scanning direction.

In this example, the optical print head 1 is described in which organic EL elements serving as the light source are arranged in the main scanning direction (i.e., the rotation shaft direction of the image bearing drum).

This description is true in a solid scanning system in which an LED array serves as the light source.

The organic EL substrate 100 has a glass substrate 101 serving as a base on which metal interconnection is patterned, an organic layer 102, and a sealing glass 103 (Refer to FIG. 3C).

Among the metal interconnection patterns formed on the glass substrate 101, an aperture 104 is formed on the portion on which the organic layer 102 is formed.

The organic layer 102 is laminated in such a manner that the beams of light from the organic layer 102 are emitted downward (right side on FIG. 3C) and transit the glass substrate 101 to exit from the reverse plane of the installed plane, which is a bottom emission system.

The aperture 104 and the organic layer 102 are formed based on the number of pixels corresponding to the main scanning direction.

For example, if the pitch p is 21 μm, which corresponds to 1,200 dpi, about 14,000 pixels are arranged in the A3 (297 mm) width and, about 10,200 pixels, the A4 (216 mm) width.

Figure 3A:
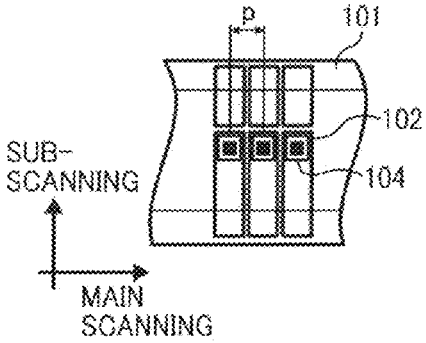
FIGS. 3A, 3B, and 3C are diagrams illustrating an example of an optical print head of the present disclosure.
Figure 3B:
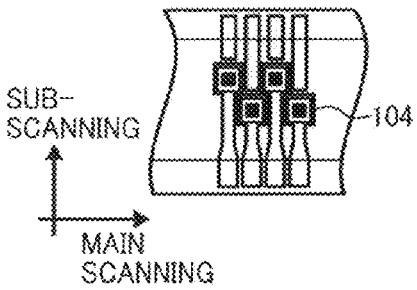
Figure 3C:
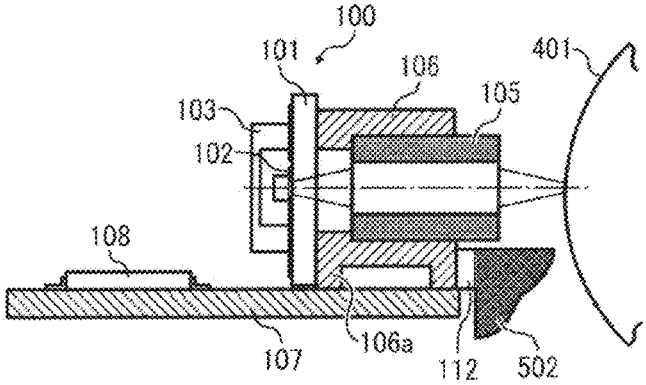

FIG. 3A is a diagram illustrating an example of a single line and FIG. 3B is a diagram illustrating an example of a zigzag-arrangement with a predetermined gap in the sub-scanning direction (up and down direction in FIG. 3)

By such a zigzag arrangement, the aperture can be increased.

The diffusion light radiated from the luminous (light emission) surface of the organic layer 102 is focused on a minute spot on the surface of a photoreceptor 401 serving as an image bearing member by the rod lens array 105.

Since the light-emitting surface is projected on the surface of the photoreceptor 401 with the same magnification, all the pixels are required to have the same light-emitting surface size to avoid uneven image density.

Therefore, in this embodiment, the diameter of the beams is determined by the aperture 104 to have the same spot diameter for all the pixels.

Two gradient index type rod lens arrays having a cylinder form with a gradient index having a quadratic curve distribution in the radius direction are bundled in a zigzag manner to form the rod lens array 105 (refer to FIGS. 1 and 2).

Although the gradient index type rod lens arrays are used In this embodiment, lens arrays in which spherical or aspherical lenses are arranged in array can be also used.

As illustrated in FIG. 3, the glass substrate 101 and the rod lens array 105 are integrally held by being fit into the housing 106 having a frame form to be positioned in such a manner that the light-emitting surface of the glass substrate 101 and the light entering surface of the rod lens array 105 contact a spacer 106*a* while facing each other in order for the luminous surface of the organic layer 102 and the surface of the photoreceptor 401 to have a conjugate relationship.

A thin film transistor (TFT) for switching to drive the organic EL elements is provided per pixel and integrated in a driving IC 108 installed on a print substrate 107. By controlling the current applied to the organic EL element based on the preset light amount correction data, the amount of beams of light radiated from the aperture 104 is equal for each pixel.

Figure 4:
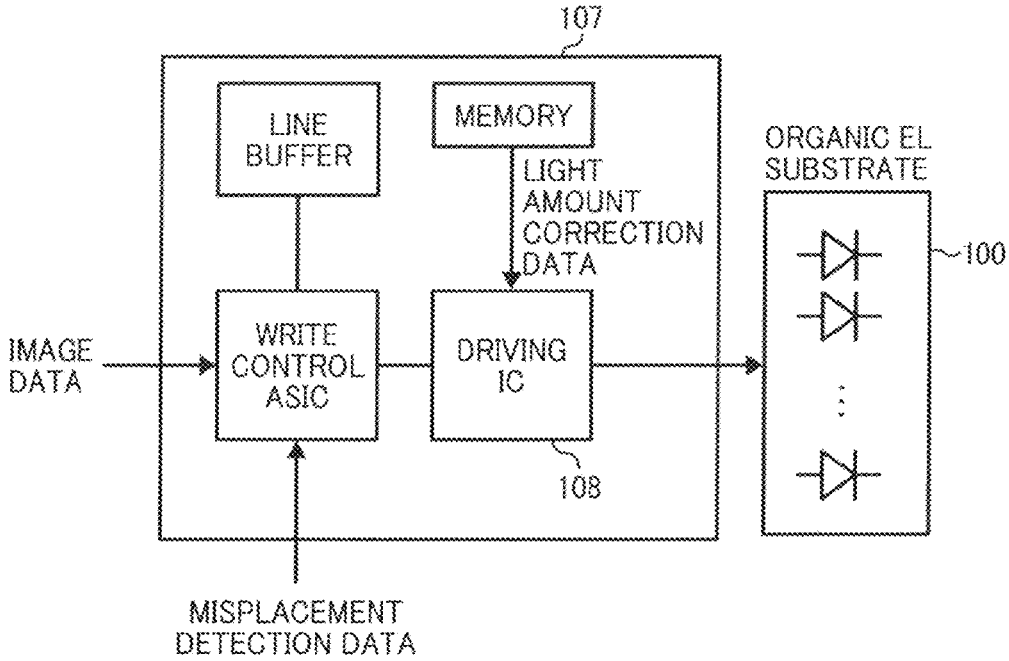
FIG. 4 is a control block chart.

As illustrated in FIG. 4, the print substrate 107 has a line buffer that spreads image data per line and temporarily saves them.

According to dot misplacement data from a misplacement detection sensor described later, by controlling the light emission timing of writing data of each pixel read from the line buffer in the sub-scanning direction, a writing control circuit to correct skewing and bending of the pixel arrangement on the surface of the image bearing member is installed.

The housing 106 is provided in such a manner that the light-emitting surface of the glass substrate 101 vertically stands on the print substrate 107, i.e., the light radiation direction of the organic EL element is parallel to the surface of the print substrate 107.

In addition, the metal interconnection patterns of the glass substrate 101 are connected to the housing 106.

The print substrate 107 is jointed with a supporting member 118 with their substrate base surface parallel to the main scanning surface parallel to the optical axis of the rod lens array 105 and fixed by a screw driver or a swage at the both ends of print substrate 107.

As illustrated in FIG. 1, notches 119 are formed on both ends of the supporting member 118. A turned spring 121 is inserted into a guide pin 120 that stands on the outside surface of side plate 301 or 302 (refer to FIG. 6).

One end of the turned spring 121 is engaged with the notch 119 and the other end thereof is engaged with a protrusion 122 standing on the outside plate 301 or 302.

By having such a structure, as illustrated in the arrow A in FIG. 1, the supporting member 118 and the print substrate 107 are constantly pressed toward the image bearing member so that projections 112 provided at both ends of the photoreceptor shaft in the housing 106, abut surface plates 502 and 503 (refer to FIGS. 3C and 7) that rotatably supports the image bearing drum.

As described above, since toner and paper dust scattered by rotation of the image bearing drum and the development roller adhere to the light-emitting surface of the rod lens array 105, it is necessary to clean the light-emitting surface periodically to maintain the proper irradiation amount of light over time.

Figure 5A:
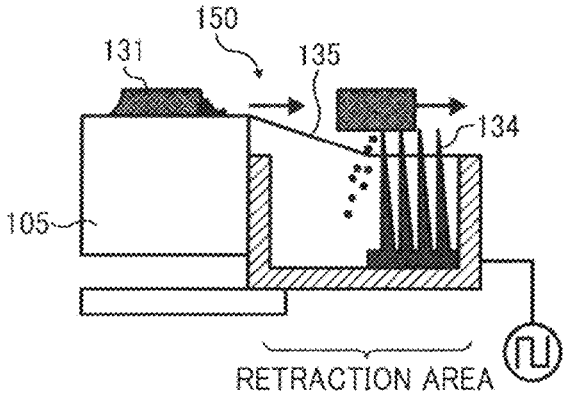
FIG. 5A is a cross section illustrating an example of an evacuation area from the main scanning plane.
Figure 5B:
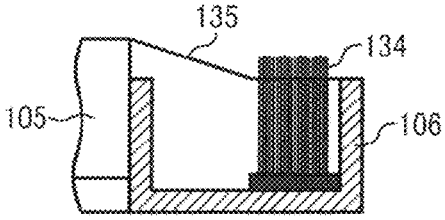
FIG. 5B is a cross section illustrating another example of the evacuation area.
Figure 5C:
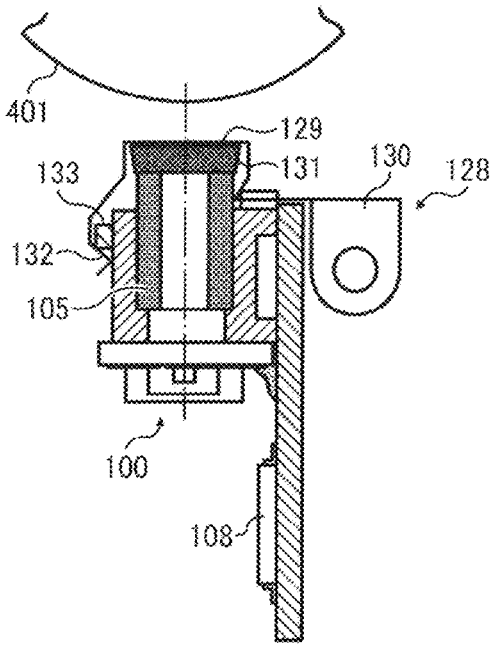
FIG. 5C is a cross section of an example of a cleaner of the present disclosure.

As illustrated in FIG. 1 and FIG. 5C, the cleaner 128 has a main frame 129 formed by sheet-metal processing and a pad 131 made of unwoven fabric such as felt to wipe the light-emitting surface of the rod lens array 105.

A flange portion 130 is formed on one end (first end) of the main frame 129 relative to the sub-scanning direction and screwed to a screw shaft 136 supported in the main scanning direction by shaft bearings 139 provided at both ends of the supporting member 118. The cleaner 128 moves along the main scanning direction with the rotation of the screw shaft 136.

A bent portion 132 engaged with a protrusion 133 serving as a guide formed along the main scanning direction of the housing 106 is provided at the other end (free end: second end) of the main frame 129.

The main frame 129 rotates around the screw shaft 136 and fitted as enclosing the rod lens array 105.

The pad 131 contacts the light-emitting surface of the rod lens array 105 with a predetermined contact force by the elasticity of the plate (sheet metal).

In this Embodiment, the contact force is set to be several tens g although it depends on the thickness of the pad 131.

As described above, when the contact force is too weak, the wiping performance tends to be insufficient.

To the contrary, when the contact force is too strong, the cleaner 128 does not move smoothly, which leads to uneven wiping and damage to the light-emitting surface of the lens array 105.

Therefore, it is necessary to stably maintain the contact force over the main scanning direction.

It is possible to maintain the predetermined contact force by guiding the cleaner 128 while engaged with the protrusion 133 provided to the housing 106 that determines the position of the rod lens array 105 if the optical print head 1 is mounted onto the supporting member 118 to which the cleaner 128 is assembled.

As illustrated in FIG. 1, a pulse motor 138 is supported on the supporting member 118 and drives the screw shaft 136 to rotate via a gear 137 fixed onto the screw shaft 136 to move the cleaner 128 at a predetermined timing, thereby wiping off the light-emitting surface of the rod lens array 105.

The screw shaft 136, the gear 137, the pulse motor 138, and the shaft bearing 139 form a device to move the cleaner 128.

In this Embodiment, the light-emitting surface of the rod lens array 105 is cleaned when the power is turned on and before the process control of detecting the amount of attached toner transferred onto the transfer belt described later to adjust the image density.

It is also possible to conduct cleaning automatically when defective images having vertical streaks, etc. ascribable to uneven irradiation are produced.

Since the cleaner 128 moves while keeping a constant gap to the light-emitting surface of the lens array 105 with the predetermined contact force with which the cleaner 128 contacts the light-emitting surface of the lens array 105, the toner and the paper dust attached to the light-emitting surface are securely wiped off so that quality images are recorded stably over an extended period of time.

In addition, since the cleaner 128 is easily attached to and detached from the housing 106, the cleaner causes no trouble when the optical print head 1 is attached to and detached from the supporting member 118 to which the cleaner 128 and the moving device therefor are attached.

Therefore, it is possible to replace the optical print head 1 while the cleaner is attached and keep the constant contact force with which the cleaner 128 contacts the light-emitting surface of the lens array before and after the replacement.

FIG. 5 is a diagram illustrating retraction portions of the cleaner 128 provided at both ends of the housing 106 relative to the main scanning direction.

As illustrated in FIG. 2, there are provided ribs 135 at both ends of the housing 106 relative to the main scanning direction to guide the pad 131 to the light-emitting surface of the rod lens array 105 and retraction areas 150 to retract the cleaner 128 by releasing the contact with the light-emitting surface unless the cleaner 128 conducts cleaning.

A scraping brush 134 formed of a rubber material (refer to FIG. 5A) and a bundle of hair-implant material (refer to FIG. 5B) is provided to the retraction area 150 and brought into contact with the light-emitting surface of the rod lens array 105 to scrape off toner and paper dust trapped in the fabric of the pad 131 of the cleaner 128 that has moved into the retraction area 150.

The scraping brush 134 can be integrally molded with the housing 106.

The pad formed of the fabric such as felt is used as the cleaner 128.

If the light-emitting surface of the lens array is wiped off again while the wiped-off toner and the paper dust are still attached in the fabric, the light-emitting surface may be contaminated.

In addition, if the toner is left alone for an extended period of time, it is fixated in the end because of the wax contained in the toner.

As a result, the elasticity of the pad deteriorates, which leads to degradation of wiping ability.

In particular, if the pad is left alone while it is in contact with the light-emitting surface, the degradation of the wiping ability is accelerated.

In the present disclosure, the retraction area 150 at which the cleaner 128 does not contact the light-emitting surface is provided at one or both ends of the optical print head 1 in the main scanning direction and also the scraping device (scraping brush 134) is provided in the retraction area 150 to scrape off the toner and the paper dust attached to the cleaner 128.

Therefore, the cleaner 128 is maintained clean and securely wipes off the toner and the paper dust attached to the light-emitting surface so that quality images are recorded stably over an extended period of time.

In this embodiment, the scraping brush 134 is electroconductive and a predetermined voltage is applied thereto.

For example, a voltage reversed to that of the toner is applied.

In this embodiment, the toner is positively charged.

Therefore, a negative voltage is applied to attract the toner by the electrostatic force.

In addition, by switching the positive and negative voltage with a predetermined frequency or applying an alternate voltage to work the electrostatic force on the toner and the paper dust trapped on the fabric to easily separate them by micro-vibration for efficient retrieving from the pad 131.

The frequency for switching the positive and the negative voltage is about several tens Hz although it depends on the moving speed of the cleaner 128.

Since the toner and the paper dust are charged so that they are trapped in the fabric of the pad with another force. i.e., the electrostatic force, they won't easily separate from the pad.

Therefore, such an electroconductive member is used as used as the scraping brush 134 and a positive or negative voltage is applied according to the charge potential or the plus and minus of the applied voltage is switched.

Consequently, the charged toner and paper dust are easily separated from the fabric and the scraping-off ability is improved.

Therefore, the cleaner 128 is always kept clean and securely wipes off the toner and the paper dust attached to the light-emitting surface so that quality images are recorded stably over an extended period of time.

Figure 7:
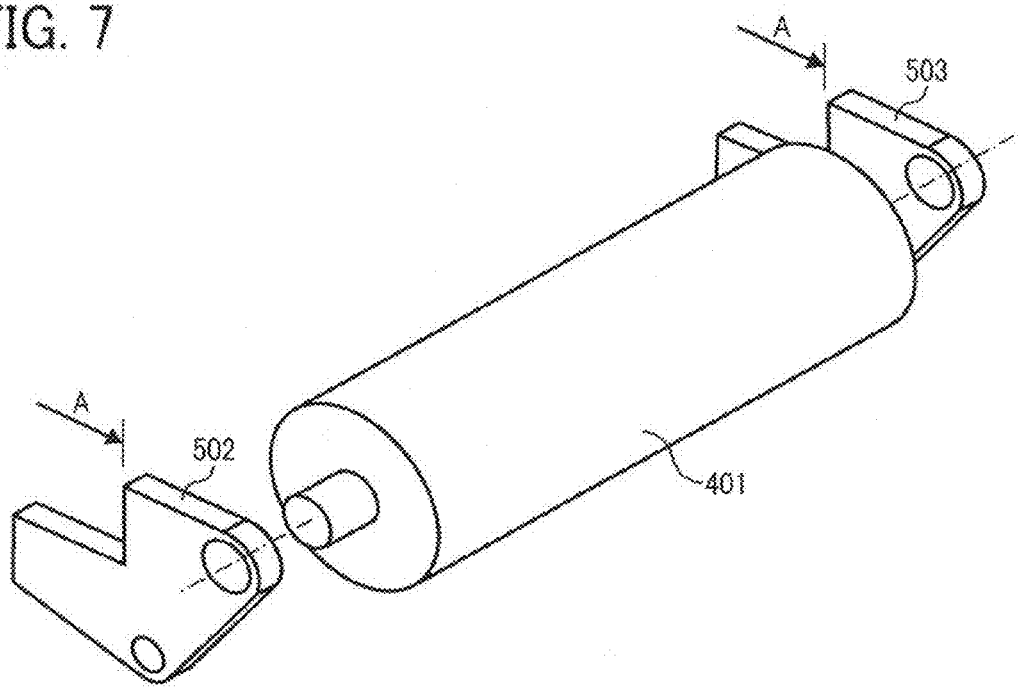
FIG. 7 is a perspective view illustrating a supporting structure of an image bearing drum.

FIG. 7 is a mechanism that supports the photoreceptor 401.

The rotation shaft of the photoreceptor 401 is supported by the side plates 502 and 503.

As described above, the supporting member 118 is biased in order to be pressed toward the photoreceptor 401 so that while the position of the rotation shaft is determined relative to the sub-scanning direction on a surface parallel to a print substrate surface 110, i.e., a surface parallel to the optical axis of the rod lens array 105, the projections 112 of the housing 106 abuts part of the side plates 502 and 503 in the direction indicated by the arrow A in FIG. 7 to keep the arrangement with the surface of the photoreceptor 401 (refer to FIG. 3C).

Figure 6:
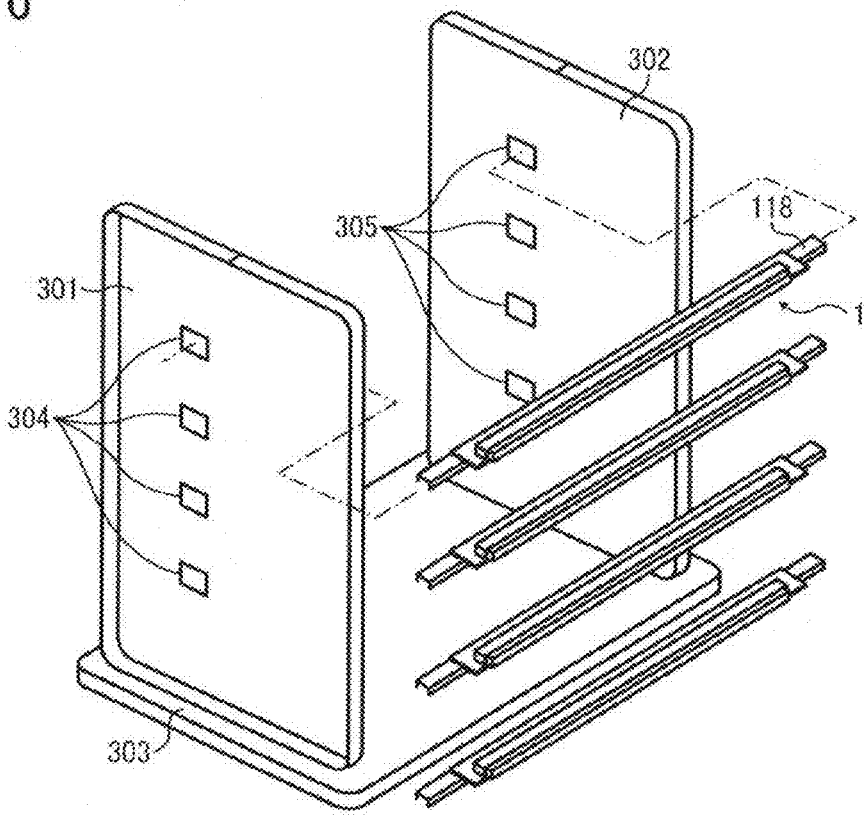
FIG. 6 is a perspective view illustrating a side plate structure of an image forming apparatus of the present disclosure.

As illustrated in FIG. 6, the structure frame of the image forming apparatus has a base plate 303 and the side plates 301 and 302 that stand on the base plate 303.

The supporting member 118 on which the optical print head 1 is mounted bridges the side plates 301 and 302.

Each end of the supporting members 118 pierces square holes 304 and 305 that are provided to the side plates 301 and 302, respectively, to determine the positions of the supporting members 118.

In this Embodiment, relative positional arrangement are maintained by providing the square holes 304 and 305 to the side plates 301 and 302, respectively to position multiple optical print heads 1 corresponding to respective colors.

As illustrated in FIG. 1, the square holes 304 of the side plate 301 on the front side have a bent portion 114 having a screw hole fitted for an adjusting screw 113.

One end of the adjusting screw 113 contacts the upper surface of the supporting member 118 to move it in the sub-scanning direction.

A coil spring 115 is engaged with a protrusion 116 of the square hole 304 and biases the supporting member 118 from downward to abut the end of the supporting member 118.

On the other hand, protrusions 117 which contact the upper surface of the supporting member 118 with two points are formed on the square hole 305 of the side plate 302 on the rear side and the coil spring 115 biases the supporting member 118 from downward as well.

By adjusting the protrusion amount of the adjusting screw 113 from the bent portion 114, the optical print head 1 is tilted toward the sub-scanning direction to correct the difference between the slopes of the lines formed on the image bearing drum (photoreceptor) 401 by multiple print heads. The detail is deferred.

A second Embodiment is described with reference to FIG. 8.

The description of the same portions as in the first Embodiment is omitted unless particularly needed.

In this Embodiment, a switching device is provided to switch between the first state in which the positions of the light-emitting surface of the lens array and the surface of the photoreceptor 401 are determined with a predetermined gap and the second state in which the biasing of the projection is broken to separate the light-emitting surface of the lens array from the surface the photoreceptor 401.

Therefore, the cleaner 128 is movable by switching to the second state.

As a result, the light-emitting surface of the lens array 105 can be securely separated from the photoreceptor 401 during cleaning and even if it is repetitively separated, the contact force to the light-emitting surface of the lens array 105 by the cleaner 128 is kept constant.

Therefore, the toner and the paper dust attached to the light-emitting surface are securely wiped off so that quality images are recorded stably over an extended period of time.

To be specific, the abutment to the side plate 502 that rotatably supports the photoreceptor (image bearing drum) 401 is released to evacuate the cleaner 128.

The structure of the housing 106 that integrally supports the organic EL substrate 100 and the rod lens array 105 and the installation thereof on the print substrate 107 are the same as in the first Embodiment.

While the turned springs 121 are inserted into the guide pins 120 that stand on the side plates 301 and 302 situated front and back in the first Embodiment, the guide pins 120 are formed on switching levers 140 and 141 which serve as the switching device and are provided to the outside surface of the side plates 301 and 302 in the second Embodiment.

Figure 8:
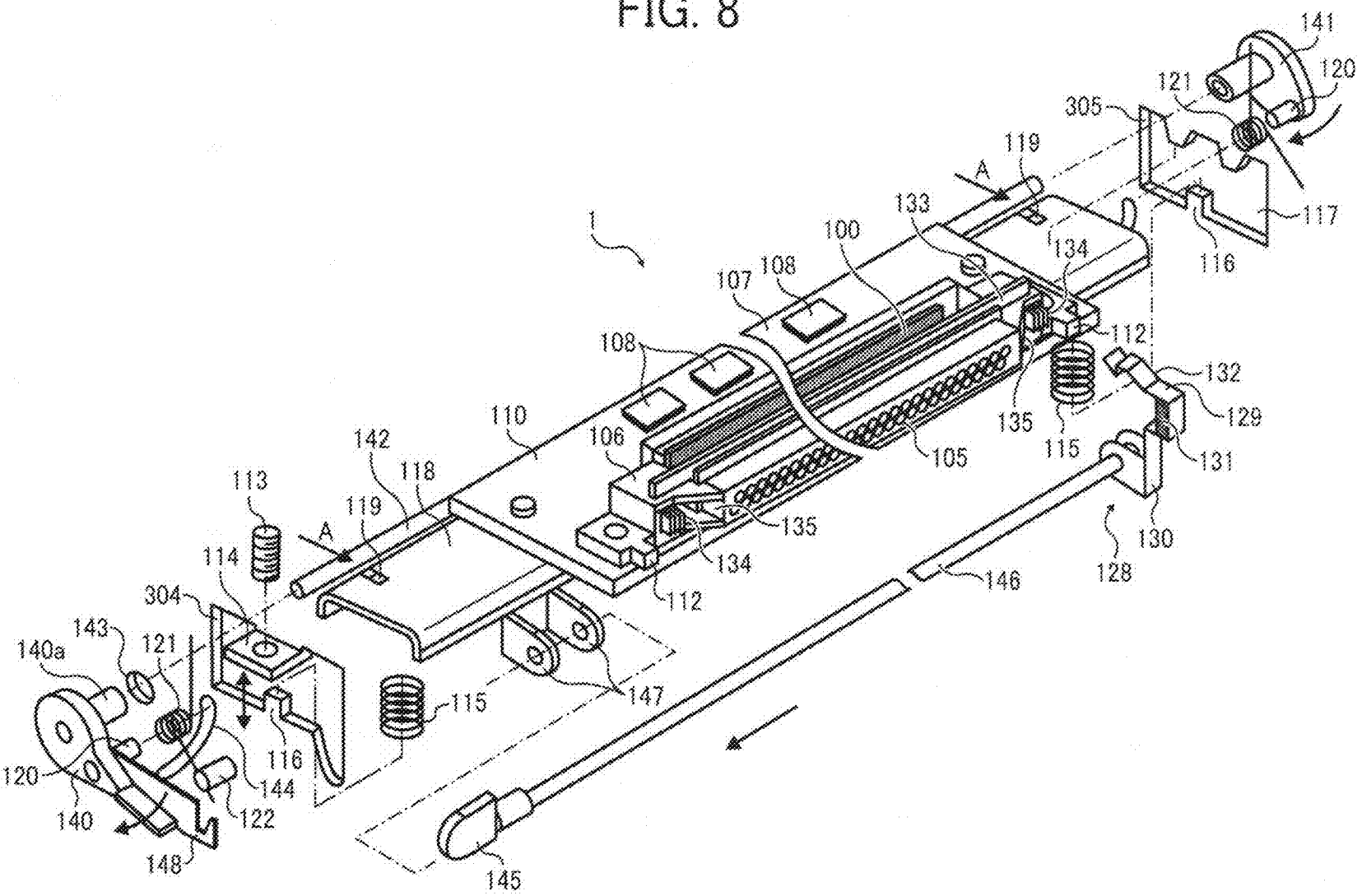
FIG. 8 is an exploded perspective view illustrating a unit in which an example of an optical print head of the second Embodiment described later.

The switching levers 140 and 141 have flange portions 140*a* which are inserted into fitting holes 143 formed on the side plates 301 and 302 situated back and front from the outside surface of the side plates 301 and 302 to link with a linking shaft 142 so that they can interlock in the direction indicated by arrows in FIG. 8.

One end of the guide pin 120 is engaged with an arc slot 144 formed on the side plate 301 or 302 situated back or front by the turned spring 121 that covers the guide pins 120.

As the switching lever 140 rotates in the right direction, the guide pins 120 moves along the arc slot 144 to release the bias of the turned springs 121 to the supporting member 118.

As the turned spring 121 engaged with the notch 119 moves along, the supporting member 118 evacuates in the direction (the direction opposite to the arrow A of FIG. 1) away from the surface of the photoreceptor 401 along the optical axis of the rod lens array 105.

A stopper portion 148 that latches a knob portion 145 described later is provided to the switching lever 140.

Therefore, the knob portion 145 is not drawn without evacuating the supporting member 118 from the image bearing drum (photoreceptor 401) by the switching lever 140.

In other words, the cleaner 128 can be moved by evacuating the supporting member 118 from the image bearing drum.

In this Embodiment, the cleaner 128 is manually movable.

The cleaner 128 has the flange 130, which is formed on one end of the main frame 129 relative to the sub-scanning direction as in the first Embodiment, and is fixed via the flange 130 on a shaft 146 supported by a shaft bearing 147 in the main scanning direction which is provided to the supporting member 118.

The cleaner 128 is moved in the main scanning direction by moving down the stopper portion 148 in the direction indicated by the arrow by the switching lever 140 to unlatch the knob portion 145 and pulling the knob portion 145 to the front side.

The knob portion 145, the shaft 146, and the shaft bearing 147 form the moving device of the second Embodiment.

To return the cleaner 128 to the latched condition, the knob portion 145 is pushed back to be caught by the stopper 148 so that the switching lever 140 can rotate back in the counter direction to the direction indicated by the arrow to regain the bias of the turned springs 121 to the supporting member 118.

As a result, the projection 112 of the housing 106 abuts the side plate 502 that rotatably supports the image bearing drum.

The bent portion 132 engaged with the protrusion 133 formed on the housing 106 along the main scanning direction is provided at the other end of the cleaner 128 relative to the sub-scanning direction and brings the pad 131 into contact with the light-emitting surface of the rod lens array 105 by elasticity of the plate (metal sheet) with a predetermined contact force.

The switching lever 140 can be applied to the first Embodiment.

This is made possible by a sequence control, for example, to supply a power to the pulse motor 138 by detecting the state of the switching lever 140 or that the supporting member 118 has evacuated from image bearing drum.

Since the cleaner 128 is movable by switching to the second state, the abutment to the image bearing drum or the member that supports the image bearing drum is broken temporarily to retract the projection 112 provided to the housing 106.

Therefore, the movable range of the cleaner 128 is not limited inside the projections 112 and the cleaner 128 can be evacuated outside the projections 112 when not conducting cleaning.

This makes it unnecessary to widen the gap between the pair of the side plates 502 and 503 that supports the rotation shaft of the image bearing drum which the projections 112 abut due to the evacuation of the cleaner 128, which results in an optimal arrangement.

Moreover, since the cleaner 128 is evacuated outside the side plates 502 or 503, it is possible to minimize the adherence of the scattered toner to the cleaner 128 due to the rotation of the image bearing drum and the development roller.

In addition, since the cleaner 128 is made movable by switching to the second state, there is no chance of moving the cleaner 128 by error while the projections 112 abut the image bearing drum or the member that supports the image bearing drum.

Furthermore, since the cleaner 128 can be attached to or detached from the photoreceptor 401 while the cleaner 128 is mounted onto the optical print head 1, it is possible to keep the cleaner 128 to contact with the light-emitting surface of the lens array with a constant contact force even when it is repetitively attached to and detached from the light-emitting surface.

Therefore, the toner and the paper dust attached to the light-emitting surface are securely wiped off so that quality images are recorded stably over an extended period of time.

A third Embodiment is described with reference to FIGS. 9 and 10.

The third Embodiment has a structure in which a substrate on which a light source is installed is arranged parallel to the surface of a print substrate.

Figure 10:
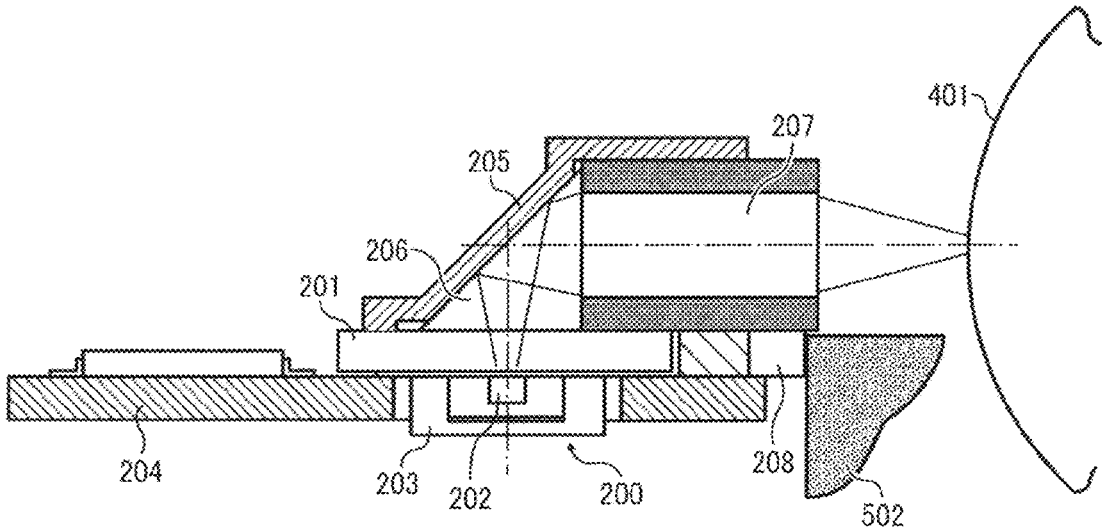
FIG. 10 is an end-on view of the optical print head of the third Embodiment from a plane perpendicular to the main scanning direction.

FIG. 10 is a cross section orthogonal to the main scanning direction.

Figure 9:
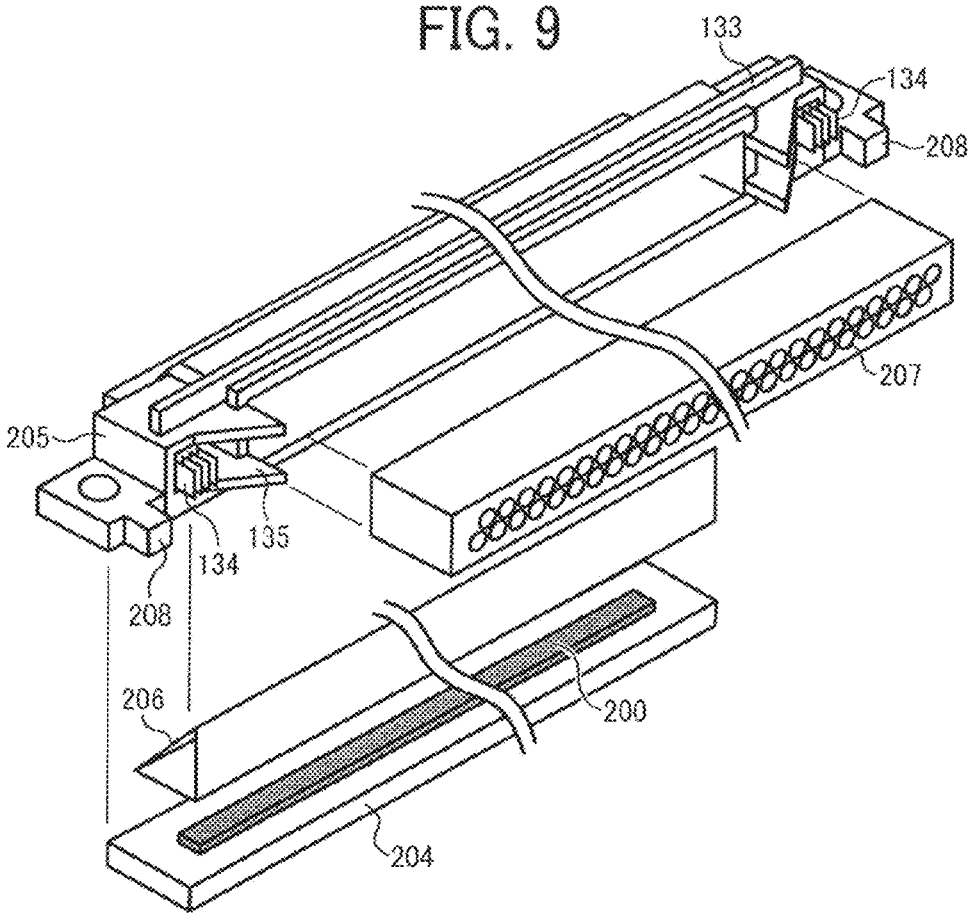
FIG. 9 is an exploded perspective view illustrating an example of an optical print head of the third Embodiment described later.

FIG. 9 is a perspective view illustrating a housing 205 that holds an organic EL (electroluminescence) substrate 200 and a rod lens array 207.

A light source is installed on the organic EL substrate 200.

The organic EL substrate 200 has a glass substrate 201 serving as a base on which metal interconnection is patterned, an organic layer 202, and a sealing glass 203 as in the first Embodiment.

The organic EL substrate 200 is installed on the upper surface of the print substrate 204 with the installed surface of the light source downward on which the metal interconnection of the glass substrate 201 is patterned, In the third Embodiment, the light-emitting surface of a prism mirror 206 is directly jointed with the light incident surface of the rod lens array 207 and the light incident surface of the prism mirror 206 is directly jointed with the light-emitting surface of the organic EL substrate 200.

The organic EL substrate 200 is mounted on the upper surface of the print substrate 204 by jointing the installation surface of the light source of the glass substrate 201 on which the metal interconnection is patterned and the housing 205 is mounted on the upper surface of the print substrate 204 to cover the upper part thereof.

The housing 205 integrally holds and positions the rod lens array 207 and the prism mirror 206 that bends the beams of light emitted from the organic layer 202 to the direction parallel to the surface of the print substrate 204.

The beams of light emitted from the organic layer 202 are bent at the slope of the prism mirror 206 to enter the rod lens array 207.

Although the beams of light is bent at the slope, each is arranged in order that the luminous surface of organic layer 202 and the surface of the photoreceptor 401 have a conjugation relationship. As in the first and second Embodiments, the print substrate 204 is constantly biased to be pushed toward the photoreceptor 401.

Therefore, the arrangement for the surface of the photoreceptor 401 is maintained by abutting the contact surface 208 of the housing 205 with part of the side plates 502 and 503 while the positions are determined relative to the sub-scanning direction along the surface parallel to the surface of the print surface 204.

A fourth Embodiment is described with reference to FIGS. 11 and 12.

Figure 12:
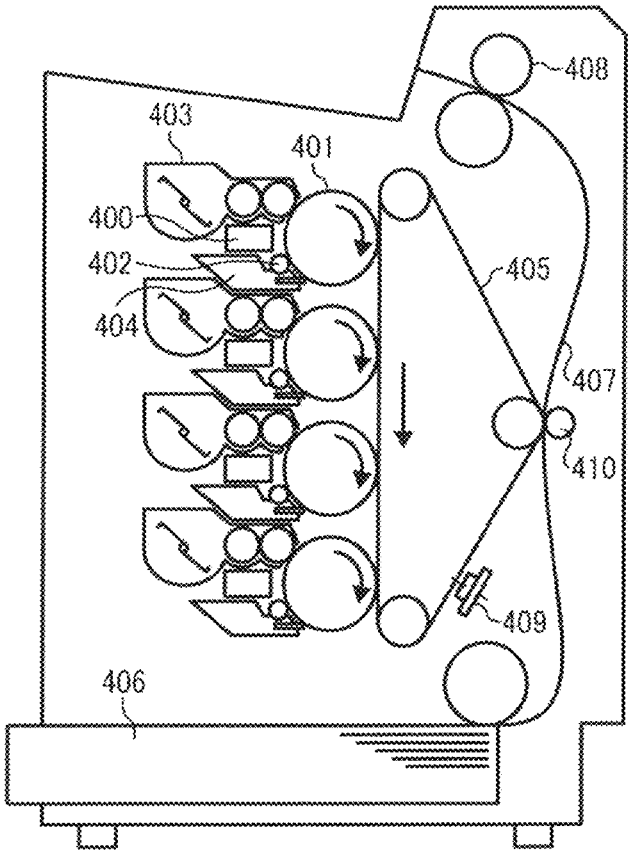
FIG. 12 is a diagram illustrating the structure of the image forming apparatus.

FIG. 12 is a diagram illustrating a color image forming apparatus employing a tandem system having multiple optical print heads 1 corresponding to each color.

The structure of the optical print head 1 is the same as in the first to the third Embodiments.

The supporting member 118 on which the optical print head 1 is mounted bridges the side plates 301 and 302 of the frame of the image forming apparatus.

The image bearing drum (photoreceptor) 401 corresponding to each color is arranged along the moving direction of an intermediate transfer belt 405.

Around the image bearing drum 401, there are provided a charging roller 402 to charge the surface of the image bearing drum 401, a development device 403 to develop a latent image formed on the surface of the image bearing drum 401 irradiated by an optical print head 400 with toner, and a cleaner 404 to scrape residual toner on the image bearing drum 401 after image transfer.

The structure is the same for each color and toner images of yellow, magenta, cyan, and black formed based on each image data are sequentially superimposed on the intermediate transfer belt 405 to form a color image.

The recording medium is supplied from a sheet feeder cassette 406 and conveyed on a transfer path 407.

A secondary transfer roller 410 transfers the image onto the recording medium from the intermediate transfer belt 405. The toner on the recording medium is fixed by a fixing device 408 after the transfer and thereafter the recording medium is discharged.

A misplacement detection sensor 409 detects the misplacement of each color toner image superimposed on the intermediate transfer belt 405 at the center, the front, and the rear of the image to correct the skewing and bending of the pixel arrangement in the belt transfer direction, i.e., sub-scanning direction, by controlling the light emission timing of writing data of each pixel in the sub-scanning direction In the color image forming apparatus employing a tandem system, since multiple independent optical print heads 400 are used according to each color, if there is variability of the pitch of adjacent dot pitches on the organic EL substrate caused by manufacturing error, a total width in the main scanning direction varies.

Figure 11:
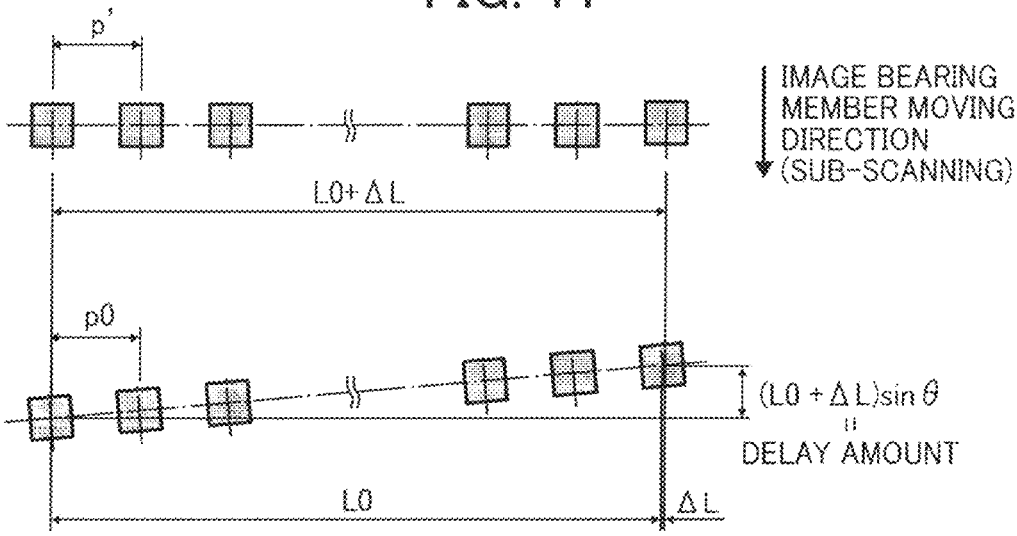
FIG. 11 is a diagram illustrating a principle of the tilting adjustment of the optical print head in the image forming apparatus related to the fourth Embodiment.

As illustrated in FIG. 11, when the ideal dot pitch between adjacent dots is p0 and the total width is L0, if, for example, the dot pitch p' changes by 0.1% for A3 size, the error A of the total width corresponding to the total width of A3 is 300 μm.

This misplacement of each color toner image leads to degradation of the image quality because it is noticeable.

Therefore, to reduce the amount of the misplacement to the undistinguishable level, i.e., 50 μm or less, the protrusion amount of the adjusting screw 113 provided to the supporting member 118 on which the optical print head 1 is installed is adjusted to tilt the optical print head 1 by θ in the sub-scanning direction to the upstream side, which is the counter direction to the rotation direction of the image bearing drum in order that the dot pitch p' projected on the main scanning line matches the ideal dot pitch p0 in this Embodiment.

On the other hand, tilting the optical print head 1 changes the pixel arrangement in the sub-scanning direction. However, the dot positions can be corrected by sequentially delaying the light emission timing of each pixel described above in order that the pixels are aligned on the main scanning lines.

For example, since the misplacement of the pixel at the final end by tilting by θ in the sub-scanning direction is $(L0+\Delta L)\sin\theta$, it is suitable to delay the light emission timing by $(L0+\Delta L)\sin\theta/v$ relative to the pixel at the start end.

"v" represents the transfer speed of the intermediate transfer belt.

With regard to arbitrary nth pixel, it is suitable to set the delay amount of the light emission timing as described above.

As described above, since the cleaner 128 is integrally supported by the supporting member 118, the contact force toward the light-emitting surface of the rod lens array 105 is kept constant even when the tilting of the optical print head 1 is adjusted in the sub-scanning direction.

What is claimed is:

1. An optical print head comprising:

a substrate on which multiple light sources aligned in a main scanning direction are mounted to emit beams of light in a direction perpendicular to a surface of the substrate;

a lens array to focus the beams of light on an image bearing member to form an image thereon;

a housing comprising a guiding portion extending in the main scanning direction, the housing positioning the substrate and the lens array;

a cleaner to clean a light-emitting surface of the lens array while moving in the main scanning direction;

a moving device operatively connected to the cleaner to move the cleaner; and a supporting member to support both the housing and the cleaner, wherein a first end of the cleaner is disposed at one end of a contact portion of the cleaner in a sub-scanning direction, perpendicular to the main scanning direction, the first end of the cleaner being screwed to a shaft supported in the main scanning direction such that the first end of the cleaner moves along in the main scanning direction as a result of a rotation of the shaft, wherein a second end of the cleaner is disposed at another end of the contact portion of the cleaner in the sub-scanning direction, opposite the first end, the second end of the cleaner being engaged with the guiding portion formed along the main scanning direction of the housing, and wherein the contact portion of the cleaner fits the light-emitting surface of the lens array with a predetermined contact force.

2. The optical print head according to claim 1, further comprising a switching device to switch between a first state in which the lens array is positioned so that the light-emitting surface of the lens array and a surface of the image bearing member are positioned opposite each other with predetermined gap therebetween by biasing the supporting member along an optical axis of the lens array and a second state in which the light-emitting surface of the lens array is retracted from the surface of the image bearing member by releasing the bias to the supporting member, wherein the moving device moves the cleaner in the second state.

3. The optical print head according to claim 1, further comprising an evacuation area where the cleaner does not face the light-emitting surface of the lens array and which accommodates a scraping member to scrape foreign objects attached to the cleaner, the evacuation area being provided on at least one end of the housing in the main scanning direction.

4. The optical print head according to claim 3, wherein the scraping member is electroconductive and a positive or negative voltage is applied thereto.

5. The print head according to claim 4, wherein the positive and negative voltage applied to the scraping member is switched at a predetermined frequency.

6. An image forming apparatus including the optical print head of claim 1, comprising:

an image bearing member;

an irradiator cooperating with the optical print head to irradiate the image bearing member to form a latent electrostatic image thereon to according to image data;

a development device to develop the latent electrostatic image with toner to obtain a visual image; and a transfer device to transfer the visual image to a recording medium.

7. The optical print head according to claim 1, wherein the cleaner makes and releases contact with the light-emitting surface of the lens array by moving in the main scanning direction along the guiding portion.

8. An optical print head comprising:

a substrate on which multiple light sources aligned in a main scanning direction are mounted to emit beams of light in a direction perpendicular to a surface of the substrate;

a lens array to focus the beams of light on an image bearing member to form an image thereon;

a housing comprising a guiding portion extending in the main scanning direction, the housing positioning the substrate and the lens array;

a cleaner to clean a light-emitting surface of the lens array while moving in the main scanning direction;

a moving device operatively connected to the cleaner to move the cleaner;

a supporting member to support both the housing and the cleaner; and an evacuation area where the cleaner does not face the light-emitting surface of the lens array and which accommodates a scraping member to scrape foreign objects attached to the cleaner, the evacuation area being provided on at least one end of the housing in the main scanning direction, wherein a first end of the cleaner is disposed at one end of a contact portion of the cleaner in a sub-scanning direction, perpendicular to the main scanning direction, the first end of the cleaner being screwed to a shaft supported in the main scanning direction at both ends of the supporting member such that the first end of the cleaner moves along in the main scanning direction as a result of a rotation of the shaft, and wherein a second end of the cleaner is disposed at another end of the contact portion of the cleaner in the sub-scanning direction, opposite the first end, the second end of the cleaner being engaged with the guiding portion formed along the main scanning direction of the housing.

9. An optical print head comprising:

a substrate on which multiple light sources aligned in a main scanning direction are mounted to emit beams of light in a direction perpendicular to a surface of the substrate;

a lens array to focus the beams of light on an image bearing member to form an image thereon;

a housing comprising a guiding portion extending in the main scanning direction, the housing positioning the substrate and the lens array;

a cleaner to clean a light-emitting surface of the lens array while moving in the main scanning direction;

a moving device operatively connected to the cleaner to move the cleaner;

a supporting member to support both the housing and the cleaner; and a scraping member to scrape foreign objects attached to the cleaner, wherein a first end of the cleaner in a sub-scanning direction, perpendicular to the main scanning direction, is rotatably supported by the supporting member to be rotatable around a shaft parallel to the main scanning direction, wherein a second end of the cleaner, opposite the first end, engages the guiding portion to contact the cleaner against the light-emitting surface of the lens array with a constant force while the cleaner moves over the light-emitting surface in the main scanning direction during cleaning of the light-emitting surface, and wherein the scraping member is electroconductive and a positive or negative voltage is applied thereto.

10. The optical print head according to claim 9, wherein the positive and negative voltage applied to the scraping member is switched at a predetermined frequency.

* * * * *